US007241481B2

(12) United States Patent
Speer et al.

(10) Patent No.: US 7,241,481 B2
(45) Date of Patent: Jul. 10, 2007

(54) METHOD OF REMOVING SULFUR ODORS FROM PACKAGES

(75) Inventors: Drew V. Speer, Simpsonville, SC (US); Cynthia L. Ebner, Greer, SC (US); Michael D. Grah, Simpsonville, SC (US)

(73) Assignee: Cryovac, Inc., Duncan, SC (US)

( * ) Notice: Subject to any disclaimer, the term of this patent is extended or adjusted under 35 U.S.C. 154(b) by 170 days.

(21) Appl. No.: 10/876,885

(22) Filed: Jun. 25, 2004

(65) Prior Publication Data

US 2005/0287318 A1 Dec. 29, 2005

(51) Int. Cl.

| | |
|---|---|
| ***B65D 81/24*** | (2006.01) |
| ***B65D 81/38*** | (2006.01) |
| ***B65D 65/00*** | (2006.01) |
| ***B32B 27/18*** | (2006.01) |

(52) U.S. Cl. ..... 428/35.2; 428/34.1; 428/35.3; 428/35.4; 428/35.7; 428/35.8; 428/36.7; 206/525; 206/524.3; 206/213.1; 252/188.28; 252/181.6

(58) Field of Classification Search ..... 252/188.28
See application file for complete search history.

(56) References Cited

U.S. PATENT DOCUMENTS

| | | | | |
|---|---|---|---|---|
| 4,008,169 | A * | 2/1977 | McGauley | 252/191 |
| 4,795,482 | A | 1/1989 | Gioffre et al. | |
| 5,011,019 | A | 4/1991 | Satoh et al. | |
| 5,447,011 | A | 9/1995 | Harand et al. | |
| 5,542,557 | A | 8/1996 | Koyama et al. | |
| 5,654,061 | A | 8/1997 | Visioli | |
| 6,073,771 | A | 6/2000 | Pressley et al. | |
| 6,255,248 | B1 * | 7/2001 | Bansleben et al. | 502/159 |
| 6,365,245 | B2 * | 4/2002 | Blinka et al. | 428/35.7 |
| 6,458,438 | B2 * | 10/2002 | Blinka et al. | 428/35.4 |
| 2002/0119295 | A1 * | 8/2002 | Speer et al. | 428/195 |
| 2005/0084632 | A1 | 4/2005 | Urlaub et al. | |

FOREIGN PATENT DOCUMENTS

| | | |
|---|---|---|
| EP | 0 366 254 A1 | 9/1989 |
| EP | 1 146 071 A2 | 10/2001 |
| WO | WO 96/22160 | 7/1996 |
| WO | WO 96/40429 | 12/1996 |

OTHER PUBLICATIONS

English language abstract of JP 04252138 A2, Fukui Kanzume KKK, (1992).
English language abstract of JP 63246166 A2, Mitsubishi Heavy Industries, Ltd., Japan, (1988).
Sind Univ. Res. J., Sci. Ser. (1985), abstract of "Fabrication of purification unit for bio-gas obtained from chicken droppings."

* cited by examiner

*Primary Examiner*—Joseph D. Anthony
(74) *Attorney, Agent, or Firm*—Mark B. Quatt

(57) ABSTRACT

An article, such as a polymeric film, sachet, purge control pad, or label, includes a sulfur scavenger. In some embodiments, an oxygen scavenger is also included. A method includes providing an article, including a sulfur scavenger and an oxygen scavenger; and subjecting the article to a dosage of actinic radiation effective to trigger the oxygen scavenger. A method of reducing the sulfur content of a package containing a food product includes either (1) providing a film including a layer including a zinc ionomer, and a layer including an oxygen scavenger; packaging the food product in the film; and storing the package for at least 24 hours; or (2) providing the food product at a temperature of ≦40° F.; providing a film including a layer including a sulfur scavenger; packaging the food product in the film; and storing the package for at least 24 hours.

4 Claims, No Drawings

METHOD OF REMOVING SULFUR ODORS FROM PACKAGES

FIELD OF THE INVENTION

The invention relates to a method of removing sulfur odors from packages, including packages that comprise an oxygen scavenging composition, and to articles, such as films, sachets, purge control pads, and labels, that comprise a sulfur scavenger and in some cases an oxygen scavenger.

BACKGROUND OF THE INVENTION

Many oxygen sensitive products, including food products such as meat and cheese, and smoked and processed luncheon meats, deteriorate in the presence of oxygen. Both the color and the flavor of foods can be adversely affected. The oxidation of lipids within the food product can result in the development of rancidity. These products benefit from the use of oxygen scavengers in their packaging.

Certain food products such as poultry and process poultry meats (e.g., sausage, ham salami, and pepperoni, e.g. turkey pepperoni) can generate sulfur off odors. The origin of these odors is most likely enzymatic or microbial degradation of sulfur containing amino acids. This is particularly a problem in high oxygen barrier packaging. Hydrogen sulfide and other sulfur containing compounds, such as mercaptans are generated during the normal shelf life of these products particularly at room temperature and to a lesser degree under refrigerated storage.

Poultry often forms sulfur-containing components during storage. Although the poultry may still be safe for consumption, the odors cause consumers to regard it as "spoiled" and return the poultry to the retailer. As a result, poultry cannot be packaged in barrier films due to the necessity for releasing the generated sulfur type off-odors. These factors limit the shelf-life of the fresh product to typically fourteen days after processing for chicken parts.

Iron based oxygen scavenging sachets have been found to be good scavengers of sulfur odors. Unfortunately, iron based oxygen scavenging sachets have their own drawbacks when used in food packaging. These drawbacks include incompatibility with metal detectors, as well as the potential for accidental ingestion of the sachet contents.

Organic, inorganic and polymeric oxygen scavengers are known, these materials typically incorporated into the packaging material itself. However, it has now been found that sulfur off-odors are sometimes exacerbated in packages containing oxygen scavengers. Thus, to replace iron-based sachets, for example with oxygen scavenger containing films, an alternative means of removing sulfur odors is needed.

An additional challenge for many packaging applications is the requirement that the packaging material, such as a film, be transparent or nearly transparent. Many functionally useful materials, either for hydrogen sulfide scavenging or oxygen scavenging, cause a film into which they are incorporated to become opaque, or at least degrade the optics of the film to an extent to make them unfit for packaging applications where the film customer or final user desires a clear film in which the contents of the package can be visually inspected from outside the package.

It has now be found that various additives can be incorporated into articles such as polymeric films, sachets, purge control pads, or labels, and scavenge sulfur odors with in many cases no or minimal impact on optical properties of the film. Materials of the present invention can adsorb hydrogen sulfide and methyl mercaptan as they are formed, and thus offer extended shelf-life of the packaged product, and/or the ability to implement an oxygen scavenger in conjunction with a sulfur scavenger.

These additives include ultra fine copper powder (with a mean particle diameter of 0.2 micrometers), more generally copper (0) powder, copper (0) on a high surface area support, copper (II) on a high surface area support, and zinc acetate. These sulfur scavengers were found to be most effective when moist. In addition, we have found that zinc oxide has also proved effective, and has an advantage of being categorized as "GRAS" (Generally Regarded as Safe) by the US Food and Drug Administration.

Other materials have also been found to be useful as sulfur scavengers include zinc stearate (also "GRAS"), copper (II) oxide, iron oxide powder and zinc ionomer (e.g., SURLYN™ available from DuPont). Nano particle sized zinc oxide can be used at relatively high loadings while maintaining good optical properties. On the other hand, while ultra fine (i.e. having a mean particle diameter of less than 0.2 micrometers) copper (0) powder is very effective, somewhat larger particle size materials (1 to 3 micrometers) are actually less colored in the polymer matrix. Larger particle copper powder is also less expensive. "Copper (0)" herein means copper in its zero valence state.

GC headspace tests were run to determine the effectiveness of various materials either in their pure state or as compounded into low density polyethylene and/or zinc ionomer. Contact ratios were used that should mimic or exceed worst-case packaging scenarios with favorable results. "Contact ratios" herein refers to the cubic centimeters of sulfurous vapor per gram of the sulfur scavenger.

Zinc ionomer can be incorporated into films that include an oxygen scavenger. Zinc stearate is GRAS and has essentially no effect on the optical properties of polymer layers. Colored iron oxide powder and copper powder can be used in polyethylene or in conjunction with zinc ionomers to further increase the capacity. Copper powder or copper oxide of the appropriate particle size can be used at levels that have acceptable optical properties.

SUMMARY OF THE INVENTION

In various aspects of the present invention:

In a first aspect, an oxygen scavenger film comprises an oxygen scavenger and a sulfur scavenger.

In a second aspect, an oxygen scavenger film comprises a layer comprising an oxygen scavenger, and a layer comprising a sulfur scavenger.

In a third aspect, a method comprises providing an oxygen scavenger film comprising an oxygen scavenger and a sulfur scavenger; and subjecting the oxygen scavenger film to a dosage of actinic radiation effective to trigger the oxygen scavenger.

In a fourth aspect, a method comprises providing an oxygen scavenger film comprising a layer comprising an oxygen scavenger, and a layer comprising a sulfur scavenger; and subjecting the oxygen scavenger film to a dosage of actinic radiation effective to trigger the oxygen scavenger.

In a fifth aspect, a sachet comprises a first composition comprising an oxygen scavenger, a second composition comprising a sulfur scavenger, and a microporous outer membrane. For example, a sachet comprises hydrotalcite bisulfite powder or sodium ascorbate powder, or some other oxygen scavenger in powder form, with a sulfur scavenger in powder form.

In a sixth aspect, a sachet comprises a layer comprising an oxygen scavenger, a layer comprising a sulfur scavenger, and a microporous outer membrane.

In a seventh aspect, a method comprises providing a sachet comprising an oxygen scavenger and a sulfur scavenger, and a microporous outer membrane; and subjecting the sachet to a dosage of actinic radiation effective to trigger the oxygen scavenger.

In an eighth aspect, a method comprises providing a sachet comprising a layer comprising an oxygen scavenger, a layer comprising a sulfur scavenger, and a microporous outer membrane; and subjecting the sachet to a dosage of actinic radiation effective to trigger the oxygen scavenger.

In a ninth aspect, a purge control pad comprises a sulfur scavenger, and an absorbent material, and optionally an oxygen scavenger. For example, a purge control pad comprises hydrotalcite bisulfite powder or sodium ascorbate powder, or some other oxygen scavenger in powder form, with a sulfur scavenger in powder form.

In a tenth aspect, a purge control pad comprises a layer comprising an oxygen scavenger, a layer comprising a sulfur scavenger, and an absorbent material.

In an eleventh aspect, a method comprises providing a purge control pad comprising an oxygen scavenger, a sulfur scavenger, and an absorbent material; and subjecting the purge control pad to a dosage of actinic radiation effective to trigger the oxygen scavenger.

In a twelfth aspect, a method comprises providing a purge control pad comprising a layer comprising an oxygen scavenger, a layer comprising a sulfur scavenger, and an absorbent material; and subjecting the purge control pad to a dosage of actinic radiation effective to trigger the oxygen scavenger.

In a thirteenth aspect, an article comprises a polymeric film, and a label adhered to one surface of the film, the label shorter in at least one dimension than the film, the label comprising a layer comprising a sulfur scavenger, and a layer comprising an adhesive or a sealable polymer.

In a fourteenth aspect, a package comprises a tray, and a lidstock adhered to the tray, wherein at least one of the tray and lidstock comprises an oxygen scavenger, and at least one of the tray and lidstock comprises a sulfur scavenger.

In a fifteenth aspect, a package comprises a tray, a lidstock adhered to the tray, and a label adhered to a surface of the lidstock facing the tray, the label shorter in at least one dimension than the lidstock; wherein the label comprises a sulfur scavenger.

In a sixteenth aspect, a method of reducing the sulfur content of a package containing a food product comprises providing a film having a layer comprising a zinc ionomer, and a layer comprising an oxygen scavenger; packaging the food product in the film; and storing the package for at least 24 hours.

In a seventeenth aspect, a film comprises a layer comprising a sulfur scavenger, the film characterized by a haze value (ASTM D 1003-95) of no more than 25%.

In an eighteenth aspect, a method of reducing the sulfur content of a package containing a food product comprises providing the food product at a temperature of less than or equal to 40° Fahrenheit; providing a film having a layer comprising a sulfur scavenger; packaging the food product in the film; and storing the package for at least 24 hours.

Definitions

"Sulfur scavenger" and the like herein means or refers to a composition, compound, film, film layer, coating, plastisol, gasket, or the like which can consume, deplete or react with hydrogen sulfide or low molecular weight mercaptans from a given environment.

"Oxygen scavenger", "oxygen scavenging", and the like herein means or refers to a composition, compound, film, film layer, coating, plastisol, gasket, or the like, whether organic or inorganic, or polymeric, which can consume, deplete or react with oxygen from a given environment.

"Film" herein means a polymeric film, laminate, sheet, web, coating, or the like, which can be used to package an oxygen sensitive product. The film can be used as a component in a rigid, semi-rigid, or flexible product, and can be adhered to a non-polymeric or non-thermoplastic substrate such as paper or metal. The film can also be used as a coupon or insert within a package.

"Polymer" and the like herein means a homopolymer, but also copolymers thereof, including bispolymers, terpolymers, etc.

"Purge control pad" herein means an absorbent pad, sometimes called a soaker pad, that is typically included in or on a tray or other support member for a food product, especially a meat product such as poultry, and that functions to absorb the juices that tend to "purge" or exude from the food product during storage. Purge control pads are typically placed on the interior bottom of a tray or other support member before placing the food product in the tray. These pads include an absorbent material such as cellulosic material, for example paper or wood pulp or viscose fibers, superabsorbent polymers and the like, and are beneficially of food-grade quality. Absorbent pads are also frequently used to line the bottom of refrigerated display cases in grocery stores.

"Sachet" herein means a usually small, closed container, such as a packet, that contains a functional material designed to interact with the interior of a container. An example is a sachet containing an iron powder. Sachets are usually placed next to or on a packaged product prior to closing the package. They are usually discrete from the packaging material, although sometimes attached to an interior wall of the package, such as the interior wall of a lidstock, or the interior wall of a tray. The outer walls of the sachet itself are permeable to the interior volume of the package to facilitate chemical or physical interaction between the functional agent inside the sachet, and the interior atmosphere of the package. The contents of the sachet are contained within a perforated or microporous outer membrane, functioning to allow the passage of hydrogen sulfide and other sulfurous gasses. The microporous films allow water vapor and gasses to rapidly enter the sachet and react with the chemical contained within, but do not allow the passage of fluids, thus the contents cannot leach out and contaminate the foodstuff. Microporous membranes per se are well known in the art. Examples include Tokuyama Soda microporous polypropylene film with a Gurley Air permeability of 100 sec/100 cc, DuPont TYVEK™ 1025 BL and DuPont TYVEK™ 1073B.

"Trigger" and the like herein means that process defined in U.S. Pat. No. 5,211,875, incorporated herein by reference in its entirety, whereby oxygen scavenging is initiated (i.e. activated) by subjecting an article such as a film to actinic radiation, having a wavelength of less than about 750 nm at an intensity of at least about 1.6 $mW/cm^2$ or ionizing radiation such as an electron beam at a dose of at least 0.2 megarads (MR), or gamma radiation, wherein after initiation the oxygen scavenging rate of the article is at least about 0.05 cc oxygen per day per gram of oxidizable organic compound for at least two days after oxygen scavenging is initiated. A method offering a short "induction period" (the time that elapses, after exposing the oxygen scavenging component to a source of actinic radiation, before the oxygen scavenging activity begins) is useful in situations where the oxygen scavenging component is desirably activated at or immediately prior to use. Triggering can thus occur during filling and sealing of a container, which is made wholly or partly from the article, and containing an oxygen sensitive material.

Thus, "trigger" refers to subjecting an article to actinic radiation as described above; "triggered" refers to an article that has been subjected to such actinic radiation; "initiation" refers to the point in time at which oxygen scavenging actually begins or is activated; and "induction time" refers to the length of time, if any, between triggering and initiation. The onset of oxygen scavenging can be measured by any convenient means such as a reduction in headspace oxygen concentration, or an increase in barrier property as in the case of an active oxygen barrier system.

All compositional percentages used herein are presented on a "by weight" basis, unless designated otherwise.

In the analytical evaluations herein:

"w" refers to a 7 day test;

"x" refers to a 14 day test;

"y" refers to a 21 day test; and

"z" refers to a 28 day test.

DETAILED DESCRIPTION OF THE INVENTION

An oxygen scavenger film of the invention can include multiple layers, dependent upon the properties required of the film. For example, layers to achieve appropriate slip, modulus, oxygen or water vapor barrier, meat adhesion, heat seal, or other chemical or physical properties can optionally be included. The film may be manufactured by a variety of processes including, extrusion, coextrusion, lamination, coating, and the like.

An outer layer of the film, such as a layer that will function as a sealant layer of the film, can comprise one or more polymers. Polymers that may be used for the outer layer or layers include any resin typically used to formulate packaging films with heat seal properties such as various polyolefin copolymers including ethylene polymer or copolymer, ethylene/alpha olefin copolymer, ethylene/vinyl acetate copolymer, ionomer resin, ethylene/acrylic or methacrylic acid copolymer, ethylene/acrylate or methacrylate copolymer, low density polyethylene, or blends of any of these materials.

Additional materials that can be incorporated into an outer layer of the film include antiblock agents, slip agents, etc.

Oxygen barrier film

High oxygen barrier films can be made from materials having an oxygen permeability, of the barrier material, less than 500 $cm^3$ $O_2/m^2$·day·atmosphere (tested at 1 mil thick and at 25° C. according to ASTM D3985), such as less than 100, more preferably less than 50 and most preferably less than 25 $cm^3$ $O_2/m^2$·day·atmosphere such as less than 10, less than 5, and less than 1 $cm^3$ $O_2/m^2$·day·atmosphere. Examples of polymeric materials with low oxygen transmission rates are ethylene/vinyl alcohol copolymer (EVOH), polyvinylidene dichloride (PVDC), vinylidene chloride/methyl acrylate copolymer, polyamide, and polyester.

Alternatively, metal foil or SiOx compounds can be used to provide low oxygen transmission to the container. Metalized foils can include a sputter coating or other application of a metal layer to a polymeric substrate such as high density polyethylene (HDPE), ethylene/vinyl alcohol copolymer (EVOH), polypropylene (PP), polyethylene terephthalate (PET), polyethylene naphthalate (PEN), and polyamide (PA).

Alternatively, oxide coated webs (e.g. aluminum oxide or silicon oxide) can be used to provide low oxygen transmission to the container. Oxide coated foils can include a coating or other application of the oxide, such as alumina or silica, to a polymeric substrate such as high density polyethylene (HDPE), ethylene/vinyl alcohol copolymer (EVOH), polypropylene (PP), polyethylene terephthalate (PET), polyethylene naphthalate (PEN), and polyamide (PA).

Multilayer films of the invention can be made using conventional extrusion, coextrusion, and/or lamination processes. Likewise, conventional manufacturing processes can be used to make a pouch, a bag, or other container from the film.

Hermetic sealing of a pouch, bag, or other container made from the film of the invention will often be beneficial.

The exact requirements of a container made from the film will depend on a variety of factors, including the chemical nature of the oxygen scavenger, amount of the oxygen scavenger, concentration of the oxygen scavenger in a host material or diluent, physical configuration of the oxygen scavenger, presence of hermetic sealing, vacuumization and/or modified atmosphere inside the container, initial oxygen concentration inside the container, intended end use of the oxygen scavenger, intended storage time of the container before use, level of initial dose of actinic radiation, etc.

Polymeric adhesives that can be used in embodiments of the present invention include e.g. ethylene/vinyl acetate copolymer; anhydride grafted ethylene/vinyl acetate copolymer; anhydride grafted ethylene/alpha olefin copolymer; anhydride grafted polypropylene; anhydride grafted low density polyethylene; ethylene/methyl acrylate copolymer; and anhydride grafted ethylene/methyl acrylate copolymer.

The sulfur scavenger

Sulfur scavengers suitable for use in the present invention include:

- copper metal, copper foil, or copper powder, where the copper is in the zero valence state;
- silica, hydrotalcite, zeolite or alumina treated with copper either in the ionic or in the zero valence state;
- zinc acetate, zinc oxide, zinc stearate, or zinc ionomer;
- iron oxide;
- copper (II) oxide;
- magnesium oxide (MgO);
- calcium oxide (CaO);
- alumina ($Al_2O_3$); and
- ceria ($CeO_2$).

Blends of any of these materials can be used, or the same sulfur scavenger can be used in more than one layer or portion of a film, sachet, purge control pad, or label; or two or more different sulfur scavengers can be used in a film, e.g. one sulfur scavenger in one layer, and a distinct sulfur scavenger in another layer of a multilayer film, or in different portions of a sachet, purge control pad, or label.

A sulfur scavenging composition in accordance with the invention can be prepared comprising silica, hydrotalcite, zeolite or alumina treated with copper in the ionic or zero valence state. The composition may be incorporated into a film structure, a sachet, a purge control pad, or a label. For example, silica, hydrotalcite, zeolite or alumina, can be treated with a copper compound to form a copper ion loaded inorganic material. This material may then be used for example to scavenge hydrogen sulfide. This material may also then be reduced under a hydrogen atmosphere to generate a copper(zero) loaded inorganic material. This material can scavenge oxygen as well as hydrogen sulfide and then be placed into a film structure, a sachet, a purge control pad (i.e. a soaker pad), or a label. As sulfurous gas is generated from the packaged product, e.g. poultry, the sulfur components are adsorbed onto the copper surface and thus removed from the product. Copper metal, foil and powder can also be used. Compositions in accordance with the invention will typically have a high surface area.

The oxygen scavenger

Inorganic and organic oxygen scavengers suitable for commercial use in articles of the present invention, such as sachets and purge control pads are disclosed in U.S. Pat. Nos. 5,977,212, 5,941,037, 5,985,169, 6,007,885, 6,228,284 B1, 6,258,883 B1, 6,274,210 B1, 6,284,153 B1, and 6,387,461 B1. These patents are incorporated herein by reference in their entirety. Inorganic scavengers include, by way of example, HTC-BS (hydrotalcite bisulfite), and $Cu^{o}X$.

Polymeric oxygen scavengers suitable for commercial use in articles of the present invention, such as films, are disclosed in U.S. Pat. No. 5,350,622, and a method of initiating oxygen scavenging generally is disclosed in U.S. Pat. No. 5,211,875. Suitable equipment for initiating oxygen scavenging is disclosed in U.S. Pat. No. 6,287,481 (Luthra et al.). These patents are incorporated herein by reference in their entirety. According to U.S. Pat. No. 5,350,622, oxygen scavengers are made of an ethylenically unsaturated hydrocarbon and transition metal catalyst. The ethylenically unsaturated hydrocarbon may be either substituted or unsubstituted. As defined herein, an unsubstituted ethylenically unsaturated hydrocarbon is any compound that possesses at least one aliphatic carbon-carbon double bond and comprises 100% by weight carbon and hydrogen. A substituted ethylenically unsaturated hydrocarbon is defined herein as an ethylenically unsaturated hydrocarbon, which possesses at least one aliphatic carbon-carbon double bond and comprises about 50% -99% by weight carbon and hydrogen. Suitable substituted or unsubstituted ethylenically unsaturated hydrocarbons are those having two or more ethylenically unsaturated groups per molecule, e.g. a polymeric compound having three or more ethylenically unsaturated groups and a molecular weight equal to or greater than 1,000 weight average molecular weight.

Examples of unsubstituted ethylenically unsaturated hydrocarbons include, but are not limited to, diene polymers such as polyisoprene, (e.g., trans-polyisoprene) and copolymers thereof, cis and trans 1,4-polybutadiene, 1,2-polybutadienes, (which are defined as those polybutadienes possessing greater than or equal to 50% 1,2 microstructure), and copolymers thereof, such as styrene/butadiene copolymer and styrene/isoprene copolymer. Such hydrocarbons also include polymeric compounds such as polypentenamer, polyoctenamer, and other polymers prepared by cyclic olefin metathesis; diene oligomers such as squalene; and polymers or copolymers with unsaturation derived from dicyclopentadiene, norbornadiene, 5-ethylidene-2-norbornene, 5-vinyl-2-norbornene, 4-vinylcyclohexene, 1,7-octadiene, or other monomers containing more than one carbon-carbon double bond (conjugated or non-conjugated).

Examples of substituted ethylenically unsaturated hydrocarbons include, but are not limited to, those with oxygen-containing moieties, such as esters, carboxylic acids, aldehydes, ethers, ketones, alcohols, peroxides, and/or hydroperoxides. Specific examples of such hydrocarbons include, but are not limited to, condensation polymers such as polyesters derived from monomers containing carbon-carbon double bonds, and unsaturated fatty acids such as oleic, ricinoleic, dehydrated ricinoleic, and linoleic acids and derivatives thereof, e.g. esters. Specific examples also include esters or polyesters of functionalized unsaturated hydrocarbons such as hydroxy terminated polybutadiene. Such hydrocarbons also include polymers or copolymers derived from (meth)allyl (meth)acrylates. Suitable oxygen scavenging polymers can be made by trans-esterification. Such polymers are disclosed in U.S. Pat. No. 5,859,145 (Ching et al.) (Chevron Research and Technology Company), incorporated herein by reference as if set forth in full. The composition used may also comprise a mixture of two or more of the substituted or unsubstituted ethylenically unsaturated hydrocarbons described above. While a weight average molecular weight of 1,000 or more is beneficial, an ethylenically unsaturated hydrocarbon having a lower molecular weight is also usable, especially if it is blended with a film-forming polymer or blend of polymers.

An additional example of oxygen scavengers which can be used in connection with this invention are disclosed in PCT patent publication WO 99/48963 (Chevron Chemical et al.), incorporated herein by reference in its entirety. These oxygen scavengers include a polymer or oligomer having at least one cyclohexene group or functionality. These oxygen scavengers include a polymer having a polymeric backbone, cyclic olefinic pendent group, and linking group linking the olefinic pendent group to the polymeric backbone.

An oxygen scavenging composition suitable for use with the invention comprises:

(a) a polymer or lower molecular weight material containing substituted cyclohexene functionality according to the following diagram:

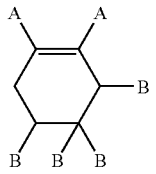

where A may be hydrogen or methyl and either one or two of the B groups is a heteroatom-containing linkage which attaches the cyclohexene ring to the said material, and wherein the remaining B groups are hydrogen or methyl;

(b) a transition metal catalyst; and (c) a photoinitiator.

The compositions may be polymeric in nature or they may be lower molecular weight materials. In either case, they may be blended with further polymers or other additives. In the case of low molecular weight materials, they will most likely be compounded with a carrier resin before use.

Also suitable for use in the present invention is the oxygen scavenger of U.S. Pat. No. 6,255,248 (Bansleben et al.), incorporated herein by reference in its entirety, which discloses a copolymer of ethylene and a strained, cyclic alkylene, preferably cyclopentene; and a transition metal catalyst.

Another oxygen scavenger which can be used in connection with this invention is the oxygen scavenger of U.S. Pat. No. 6,214,254 (Gauthier et al.), incorporated herein by reference in its entirety, which discloses ethylene/vinyl aralkyl copolymer and a transition metal catalyst.

Transition Metal Catalysts

As indicated above, the ethylenically unsaturated hydrocarbon is combined with a transition metal catalyst. Suitable metal catalysts are those that can readily interconvert between at least two oxidation states.

The catalyst can be in the form of a transition metal salt, with the metal selected from the first, second or third transition series of the Periodic Table. Suitable metals include, but are not limited to, manganese II or III, iron II or III, cobalt II or III, nickel II or III, copper I or II, rhodium II, III or IV, and ruthenium II or III. The oxidation state of the metal when introduced is not necessarily that of the active form. Suitable counterions for the metal include, but are not limited to, chloride, acetate, stearate, palmitate, caprylate, linoleate, tallate, 2-ethylhexanoate, neodecanoate, oleate or naphthenate. Useful salts include cobalt (II) 2-ethylhexanoate, cobalt stearate, and cobalt (II) neodecanoate. The metal salt may also be an ionomer, in which case a polymeric counterion is employed. Such ionomers are well known in the art.

Any of the above-mentioned oxygen scavengers and transition metal catalyst can be further combined with one or more polymeric diluents, such as thermoplastic polymers, which are typically used to form film layers in plastic packaging articles. In the manufacture of certain packaging articles well known thermosets can also be used as the polymeric diluent.

Further additives can also be included in the composition to impart properties desired for the particular article being manufactured. Such additives include, but are not necessarily limited to, fillers, pigments, dyestuffs, antioxidants, stabilizers, processing aids, plasticizers, fire retardants, etc.

The mixing of the components listed above can be accomplished by melt blending at a temperature in the range of 50° C. to 300° C. However, alternatives such as the use of a solvent followed by evaporation may also be employed.

Photoinitiators

Some of the materials useful in connection with the invention include:

1,3,5-tris(4-benzoylphenyl)benzene ($BBP^3$)

isopropylthioxanthone (ITX)

bis(2,4,6-trimethylbenzoyl)phenylphosphineoxide (IRGACURE® 819)

2,4,6-trimethylbenzoyldiphenylphosphine oxide ethyl-2,4,6-trimethylbenzoylphenyl phosphinate bis(2,6-dimethoxybenzoyl)-2,4,4-trimethylpentyl phosphine oxide 4,4'-benzoylmethyl diphenyl sulfide (BMS)

The amount of photoinitiator can depend on the amount and type of unsaturation present in the polymer, the wavelength and intensity of radiation used; the nature and amount of antioxidants used; and the type of photoinitiator used.

EXAMPLES

A. Films

Several film structures in accordance with the invention are identified below. "SS" is a sulfur scavenger; "OS" is an oxygen scavenger; "OB" is oxygen barrier; "PE" is ethylene homopolymer or copolymer, such as low density polyethylene or ethylene/alpha olefin copolymer; "ADH" is adhesive, such as polymeric adhesive; and "NYLON" is a polyamide or copolyamide.

Film Structure A.

| SS | OS |
|---|---|
| 0.50 | 0.50 |

The total gauge of Film Structure A is 1.0 mil, with the thickness of each layer, in mils, as indicated above Film Structure B.

| SS | OS | OB |
|---|---|---|
| 0.50 | 0.50 | 0.25 |

The total gauge of Film Structure B is 1.25 mils, with the thickness of each layer, in mils, as indicated above.

Film Structure C.

| SS | OS | OB | PE |
|---|---|---|---|
| 0.50 | 0.50 | 0.25 | 0.25 |

The total gauge of Film Structure C is 1.50 mils, with the thickness of each layer, in mils, as indicated above.

Film Structure D.

| SS | OS | OB | ADH | PE | PET |
|---|---|---|---|---|---|
| 0.50 | 0.50 | 0.25 | 0.20 | 0.25 | 0.50 |

The total gauge of Film Structure E is 2.20 mils, with the thickness of each layer, in mils, as indicated above. A film comprising PET (poly(ethylene terephthalate) is shown adhered by lamination, such as adhesive lamination, or any other suitable means to the PE layer of the film.

Film Structure E.

| SS | OS | ADH | NYLON | OB | NYLON | ADH | PE | PET |
|---|---|---|---|---|---|---|---|---|
| 0.50 | 0.50 | 0.20 | 0.20 | 0.25 | 0.20 | 0.20 | 0.25 | 0.50 |

The total gauge of Film Structure F is 2.80 mils, with the thickness of each layer, in mils, as indicated above.

The SS can be blended with the oxygen scavenger layer instead of, or in addition to, being present in a layer separate from the oxygen scavenger layer.

The SS layer can be used "neat", i.e. without the addition of significant amounts of other materials in the same layer as in the case of zinc ionomer, or can be blended with a polyolefin such as ethylene homopolymer or copolymer. When EMCM or other oxygen scavengers are used to scavenge oxygen from the headspace of a package or container, it is sometimes important that the SS layer have a sufficiently high oxygen permeability (oxygen transmission rate) to allow the oxygen from the headspace to move through the film structure to the oxygen scavenger layer at a sufficient rate to effect the oxygen scavenging functionality of the film. With increasing thickness of the SS layer, the presence of increasing amounts of blended polyolefin can aid in controlling the overall oxygen transmission rate of the SSC layer.

The SS layer can function as a sealant layer, and can comprise, in addition to the SS material, an EAO (ethylene/alpha olefin copolymer), a propylene polymer or copolymer, such as ethylene/propylene copolymer, or an ethylene homopolymer or copolymer, such as low density polyethylene or ethylene/vinyl acetate copolymer, or ethylene/acrylic or methacrylic acid copolymer, or ionomer, or any combinations thereof, in any appropriate percentages.

Additional materials, including polymeric materials or other organic or inorganic additives, can be added to any or all of the layers of the above structures as needed, and additional film layers can be included either within the film structure, or adhered to an outer layer thereof.

Film as described herein can be produced by any suitable method, including coextrusion, extrusion coating, lamination, extrusion lamination, etc.

The sealant side of the PE layer of structures D and E, i.e. that side of the layer that will adhere to the PET film, can alternatively be adhered to another polymer, to paperboard, or to foil such as metal foil.

Films useful in connection with the invention can have any suitable number of layers, such as a total of from 2 to 20 layers.

In general, the film can have any total thickness desired, and each layer can have any thickness desired, so long as the film provides the desired properties for the particular packaging operation in which the film is used. Typical total thicknesses are from 0.5 mils to 15 mils, such as 1 mil to 12 mils, such as 2 mils to 10 mils, 3 mils to 8 mils, and 4 mils to 6 mils.

In the above film structures, the interface between the oxygen barrier layer and the oxygen scavenger layer will typically include an adhesive or tie layer, such as one of the polymeric adhesives described herein.

Film of the present invention can optionally be oriented by stretch orienting techniques, such as trapped bubble or tenter frame methods well known in the art. The film can thereafter be annealed, or can exhibit a free shrink (ASTM D 2732-83) at a temperature of 200° F. of e.g. at least 8%, such as at least 10%, or at least 15% in either or both of the longitudinal and transverse directions. Possible ranges for heat shrinkable embodiments of film of the invention include free shrink at a temperature of 200° F. of from 8% and 50%, such as from 10% to 45%, or from 15% to 40% in either or both of the longitudinal and transverse directions.

Film of the present invention can optionally be crosslinked, by chemical means, or by irradiation such as by electron beam irradiation at a dosage of from 10 to 200 kiloGrays.

B. Sachets

A sachet in accordance with the invention comprises a composition including a sulfur scavenger as defined herein, optionally including other materials, such as an oxygen scavenger or a carbon dioxide generator. The sachet includes at least one porous outer wall with sufficient permeability to allow the sulfur scavenger to interact with sulfurous compounds, such as hydrogen sulfide and methyl mercaptan, that may be present in the interior headspace of the package into which the sachet is placed. Of course, the number and size of the sachets can be selected for each package as appropriate, determined by the evaluation of such factors as the nature of the product being packaged, size and mass of the product being packaged, nature of the sulfur scavenger, package format, desired shelf life, etc.

C. Purge Control Pads

A purge control pad in accordance with the invention comprises a composition including a sulfur scavenger as defined herein, optionally including other materials. The purge control pad includes absorbent materials well known in the art for absorbing or adsorbing meat juices or other exudate of a packaged product. One or more such pads can be placed in a package before the product has been placed in the package, and/or after the product has been placed in the package. The number and size of the purge control pads can be selected for each package as appropriate, determined by the evaluation of such factors as the nature of the product being packaged, size and mass of the product being packaged, nature of the sulfur scavenger, package format, desired shelf life, etc. Absorbent pads are also used to line the bottom of refrigerated display cases in grocery stores. Such absorbent pads benefit from the incorporation of a sulfur scavenger as well as other odor scavengers such as silica, zeolites, activated carbon and the like.

D. Labels

A label in accordance with the invention comprises a composition including a hydrogen sulfide scavenger as defined herein, optionally including other materials. The label is typically small, and smaller in one or both dimensions than the substrate on which it is adhered. The substrate can be the interior surface of a lidstock, the interior wall of a tray, etc. The label can be adhered by any suitable means, such as the application of a pressure sensitive adhesive, to bond the label to the substrate. Alternatively, the label can include a layer that is sealable by the application of heat, ultraviolet radiation, or the like, to the label and/or substrate. One or more such labels can be placed randomly, or in a pattern, on an interior wall of a lidstock, tray, or package wall before a product has been placed in the package, and/or after the product has been placed in the package. The number and size of the labels can be selected for each package as appropriate, determined by the evaluation of such factors as the nature of the product being packaged, size and mass of the product being packaged, nature of the sulfur scavenger, package format, desired shelf life, etc.

Although the films, sachets, purge control pads, and labels of the present invention have been described primarily with respect to food packaging, those skilled in the relevant art will appreciate that the present invention has utility in non-food packaging applications as well, where it is desired to remove or reduce the sulfur off odors inside a container, or to remove or reduce (for reasons other than off-odor) the amount of sulfur compounds present in a container.

Experimental Data

Synthesis of CuX via Ion Exchange

A composition was prepared as follows. Zeolite (100 g Zeolite X, available from the Davison division of W. R. Grace & Co.) was placed into a resin kettle equipped with a heating mantle, condenser and a mechanical stirrer. The zeolite was exchanged 3 times with 0.1 M copper (II) chloride and one time with 1.0M copper (II) chloride at 20% solids, by heating the mixture to 80° C. for one hour and then cooling the material and vacuum filtering using a Buchner funnel. After all of the exchanges were complete, the filter cake was washed with deionized water and vacuum dried at 110° C. until reaching a constant weight. This yields Cu (II) X, of the invention, which can be used for scavenging hydrogen sulfide.

The material was reduced by hydrogenation in the presence of approximately 100 psi of $H_2$. This resulted in the oxygen and sulfur scavenging material, $Cu^0X$, of the invention. Alternatively, hydrotalcites, other zeolites, alumina, kaolin, clay or silica can be used as the inorganic support.

Synthesis of CuX via Impregnation

A composition was prepared as follows. Zeolite (100 g Zeolite X, available from the Davison division of W. R. Grace & Co.) was placed into a beaker. A solution of 45.4 g copper (II) nitrate in 74 g distilled water was added. The zeolite water mixture was stirred until uniformly mixed and then vacuum dried at 110° C. until reaching a constant weight. The material was then calcined in a muffle furnace utilizing a 2 hour ramp up to 400° C. holding for 2 hours and then cooling to room temperature. This yields Cu (II) X, of the invention, which can be used for scavenging hydrogen sulfide.

The material was reduced by hydrogenation in the presence of approximately 100 psi of $H_2$. This resulted in the oxygen and sulfur scavenging material, $Cu^0X$, of the invention. Alternatively, hydrotalcites, other zeolites, alumina, kaolin, clay or silica can be used as the inorganic support.

Synthesis of Copper Exchanged Hydrotalcites

Water (140 ml) was charged to a 500 ml 3-neck round bottom flask fitted with a condenser, thermocouple, and mechanical stirrer, and purged ten minutes with nitrogen. Copper (II) sulfate (30 g) was added and stirred until dissolved. Hydrotalcite (40 g, La-Roche (UOP) Acetate modified HTC) was added and the slurry heated to 95° C. for various lengths of time (1,2,4,8,or 24 hours), while stirring under nitrogen. The slurry was allowed to cool to room temperature. The slurry was transferred to the nitrogen glove box and vacuum filtered and rinsed with 500 ml of $N_2$ purged water. The moist solid was dried in a vacuum oven at 80° C. for 8 to 16 hours. The experiment was also conducted using copper (II) chloride to effect the ion exchange.

Synthesis of Hydrotalcite Bisulfite (Oxygen Scavenger)

A 500 ml 3-neck round bottom flask was equipped with a stirrer and nitrogen inlet. Deionized water, 170 ml, was charged to the flask. The system was purged with nitrogen for 15 minutes and then 30 g sodium bisulfite was added and stirred until dissolved. Hydrotalcite powder, 40 g, was added with stirring. The slurry was stirred at room temperature for 2 hours. The flask was then taken to the glove box and the slurry was vacuum filtered under a nitrogen atmosphere. The filter cake was washed with 500 ml of $N_2$ purged water. The filter cake was placed in a tared, pyrex dish, and placed in a vacuum oven, which was heated to 80° C. under full vacuum. Drying was continued until the sample reached a constant weight, at between 8 and 16 hours.

Analytical Testing

An analytical method was developed for the analysis of hydrogen sulfide similar to the method described in U.S. Pat. No. 5,654,061 (Visioli), incorporated herein by reference in its entirety. Each formulation was tested in triplicate For each powder sample, 5 to 40 milligrams of sample powder was placed in a 24 milliliter glass vial and capped with a MININERT™ valve closure, available from VICI Precision, while in a nitrogen box. Sample weights are noted in Table 2 below. Then, 250 microliters of $H_2S$ or methanethiol gas was injected into the vial. After 15 minutes, and at subsequent times, the concentration of the remaining $H_2S$ or methanethiol was measured by withdrawing 250 microliters of the headspace in the sample vial into a gas chromatograph (GC). The GC was fitted with a GS-GASPRO™ column available from J&W Scientific and a thermal conductivity detector, Alternatively, a 1 cc injection was made on a GC/MS instrument equipped with a 30 m DB-5 capillary column. Results are presented in Tables below.

The inorganic additive can be placed in the inside layer (the layer of the film that will be closest to the packaged product) of a film structure, a sachet, a purge control pad, or a label, or contained as a powder within a sachet, a purge control pad, or a label, where it will adsorb sulfur compound off-odors, thus allowing for an extension in shelf life.

Preparation of Film Samples Containing Sulfur Scavenging Materials

Sample test formulations of several sulfur scavengers were compounded into various polymers as shown below in Table 1 to form sulfur scavenging compositions.

TABLE 1

Polymers used in Sulfur Scavenging Compositions

| Designation | Type | Tradename/Supplier |
|---|---|---|
| PE1 | LLDPE | DOWLEX 2045-04 ™/Dow |
| PE2 | LLDPE | EXACT 3024 ™/ExxonMobil |
| ION1 | Zinc ionomer | SURLYN ™ 1705/DuPont |

A Brabender PLASTICORDER™ was used to blend the materials. The resin was added to the Brabender. Once the polymer was melted the scavenging additive was added. The composition was blended for between 5 and 15 minutes and then removed from the chamber. Compression molded films were prepared using a Carver press. The pressed films were cut, weighed and tested. The results are detailed in Tables below.

Poultry Testing

Based on the analytical GC tests, the best performing materials were placed into sachets for poultry packaging tests. The sachet pouches were prepared with one side of the pouch made of a microporous membrane material, such as a TOKUYAMA™ membrane. Microporous films have high moisture vapor transmission rates and are not permeable to liquid water. They allows gases into and out of the sachet but do not allow the chemicals to leach out and contaminate the foodstuff. The other side of the sachet was an impermeable polymer barrier film, P640B™.

The sachets were about 2"×2" in size. Either 1 gram or 3.5 g of each scavenger or blend was placed in the sachet pouch and heat sealed. The sachets were packaged in P640B barrier bags with chicken parts. The sachets were placed underneath the chicken part with the barrier side of the sachet down and the Tokuyama film side against the chicken. The parts were vacuum-sealed into the P640B™ bags and stored in the refrigerator at 4° C. for up to 28 days. Enough samples of each type of sachet were prepared so that two packages of each sachet type could be opened for organoleptic testing, with one set of samples being removed every week for the testing.

For some of the samples, a five member panel conducted a blind "sniff" trial of the packaged samples and the results are given below in Tables 10 through 12.

Results

The values reported in the Tables are the averages of three samples. The average concentration of $H_2S$ injected into each vial was about 250 μL. The Time 0 reading was measured within a few minutes of the initial injection. The materials were tested as received, dry. The data is reported in Table 2.

TABLE 2

Hydrogen Sulfide Scavenging

| Example | Sample Amount grams | Hydrogen Sulfide ppm 0 | 15 min | 1 hour | 4 hours | 24 hours | 4 days | 7 days | 14 days |
|---|---|---|---|---|---|---|---|---|---|
| Control-empty vial | | n/a | 15065 | 15689 | 15137 | 14599 | 14808 | 14063 | n/a |
| silica gel (grade 9383, 230–400 mesh) | 0.01 | n/a | 13770 | 13612 | 13173 | 13532 | 11063 | 10114 | 6502 |
| silica gel (grade 10181, 35–70 mesh) | 0.01 | n/a | 13575 | 13312 | 13042 | 14023 | 12087 | 12561 | 8679 |
| ACTI-GEL ™ 208 | 0.0138 | 13691 | 13291 | 13187 | 12273 | 8080 | 5033 | 3378 | 893 |
| sodium Y zeolite | 0.01 | 12957 | 14547 | 13730 | 12822 | 10866 | 7641 | 4771 | 3519 |
| molecular sieves, 3A | 0.011 | 13964 | 14741 | 13757 | 11845 | 8185 | 7604 | 6455 | 6143 |
| molecular sieves, 4A powder | 0.016 | 12364 | 11241 | 9422 | 7738 | 6605 | 6802 | 6534 | 5775 |
| molecular sieves, 5A | 0.01 | 8328 | 765 | 0 | n/a | n/a | n/a | n/a | n/a |
| molecular sieves, 5A | 0.013 | 9865 | 659 | 639 | 0 | n/a | n/a | n/a | n/a |
| molecular sieves, 5A 5 mg | 0.0052 | 11546 | 7317 | 6921 | 5460 | 5806 | 3202 | n/a | n/a |
| molecular sieves, 13X | 0.0159 | 8913 | 0 | n/a | n/a | n/a | n/a | n/a | n/a |
| molecular sieves, organophilic | 0.0126 | 10373 | 12860 | 11038 | 9852 | 3461 | n/a | n/a | n/a |
| ABSCENTS ™ 2000 | 0.0139 | 13202 | 13872 | 13865 | 12746 | 12149 | n/a | n/a | 3301 |
| ABSCENTS ™ 3000 | 0.0141 | 12585 | 12823 | 12177 | 9708 | 5570 | n/a | n/a | 2260 |
| LaRoche HTC | 0.01 | n/a | 14189 | 13694 | 12961 | 12266 | n/a | 6438 | 0 |
| LaRoche HTC-BS, synthesized | 0.01 | n/a | 14432 | 13946 | 12994 | 9253 | n/a | 1673 | 420 |
| JM Huber HYSAFE ™ 510 HTC | 0.01 | n/a | 13336 | 12998 | 12632 | 11225 | 7897 | 5406 | 3250 |
| HYSAFE ™ 510 HTC-BS, synthesized | 0.01 | n/a | 12712 | 12397 | 12042 | 11221 | n/a | 8907 | 7196 |
| JM Huber HYSAFE ™ 530 HTC | 0.01 | n/a | 13375 | 13267 | 12849 | 12112 | 9255 | 6812 | 3871 |
| HYSAFE ™ 530 HTC-BS, synthesized | 0.01 | n/a | 10148 | 9617 | 8185 | 6586 | n/a | 3595 | 644 |
| copper powder, 3μ dendritic (Aldrich cat # 35745-6) | 0.013 | 13527 | 12921 | 11393 | 9158 | 0 | | | |
| copper powder, 3μ dendritic (Aldrich cat # 35745-6), 20 mg | 0.0231 | 11317 | 9668 | 8026 | 2769 | 0 | | | |
| copper powder, 3μ dendritic (Aldrich cat # 35745-6), 40 mg | 0.0439 | 9563 | 6157 | 2152 | 0 | 0 | | | |
| copper powder, 1μ (Aldrich cat # 44750-1) | 0.01 | n/a | 8010 | 6447 | 4611 | 1089 | n/a | | |
| copper powder, 1μ (Aldrich cat # 44750-1) | 0.021 | 11470 | 8145 | 6160 | 3242 | 579 | | | |
| copper powder, 1μ (Aldrich cat # 44750-1), 20 mg | 0.0243 | 8513 | 5077 | 2512 | 608 | 0 | | | |

TABLE 2-continued

Hydrogen Sulfide Scavenging

| Example | Sample Amount grams | Hydrogen Sulfide ppm 0 | 15 min | 1 hour | 4 hours | 24 hours | 4 days | 7 days | 14 days |
|---|---|---|---|---|---|---|---|---|---|
| copper powder, 1μ (Aldrich cat # 44750-1), 40 mg | 0.0415 | 7757 | 680 | 0 | | | | | |
| Alfa Aesar copper powder <0.2 micron | 0.0224 | 6119 | 0 | | | | | | |
| Alfa Aesar copper powder 3–5 micron | 0.0229 | 8248 | 2439 | 1432 | 0 | | | | |
| copper foil | | n/a | 13713 | 13611 | 13136 | 13004 | | 12287 | 11287 |
| copper (II) oxide | 0.0185 | 13382 | 14651 | 14103 | 12811 | 11250 | | 3828 | 2028 |
| blend of Cu powder (447501) & 5A molecular sieves | — | 11143 | 4977 | 4257 | 2929 | 0 | | | |
| blend of Cu powder (477501)/5A molecular sieves/ LaRoche HTC-BS | — | 10919 | 6855 | 5408 | 2381 | 0 | | | |
| ZnO Aldrich, <1μ | 0.0120 | 11442 | 8540 | 6422 | 4108 | 1190 | 641 | | |
| zinc acetate dihydrate | 0.0205 | 13190 | 0 | | | | | | |
| activated carbon | 0.0118 | 11404 | 10838 | 8280 | 4564 | 453 | | 0 | |
| iron(III) sulfate heptahydrate | 0.0147 | 13264 | 13975 | 12376 | 10676 | 14015 | 14346 | | |
| iron oxide black, hydrated | 0.0127 | 10242 | 0 | | | | | | |
| $Cu^0X$ | 0.01 | 13374 | 13395 | 12994 | 11718 | 6727 | 2231 | 0 | |
| $Cu^0X$ 20 mg | 0.0216 | 12911 | 13391 | 12022 | 11987 | 10742 | 2640 | 0 | |
| $Cu^0X$ 40 mg | 0.0441 | 11897 | 11408 | 10142 | 5681 | 1835 | 0 | | |
| Cu(II)X | 0.01 | 7624 | 4200 | 3369 | 2169 | 0 | | | |
| Cu(II)-HTC - copper (II) sulfate (8 hr @ 95 C) | 0.0101 | 9262 | 8503 | 6990 | 4551 | 0 | | | |
| Cu(I)-HTC - copper (I) chloride | 0.0101 | 10873 | 8313 | 6123 | 2895 | 0 | | | |

As can be seen by the data in Table 2, several of the clay type molecular sieve materials showed excellent speed of scavenging and capacity, especially the 5Å and 13×sieves. In these tests the $H_2S$ was scavenged so quickly that the time 0 reading was already decreased substantially in the few moments between injection and before it could be tested. These samples absorbed all of the $H_2S$ in between 15 minutes and 4 hours. The ABSCENTS™ materials are also aluminosilicate zeolite type materials and showed good scavenging with complete $H_2S$ removal in 24 hours. The 3 Å (3 angstroms) and 4 Å (4 angstroms) molecular sieves scavenged somewhat but were significantly slower. The other absorbent porous materials such as silica, ACTIGEL™ 208 (magnesium aluminosilicate), Y zeolite, and hydrotalcites (HTC) scavenged slowly. The oxygen scavenging modified hydrotalcites HTC-BS materials also scavenged slowly.

The data in Table 2 shows that the copper powders function well as $H_2S$ scavengers with the finer particle sizes scavenging faster. A<0.2 μm copper powder from Alfa Aesar scavenged all of the injected $H_2S$ in less than 15 minutes. The 1 to 5 μm copper powders scavenged in between 1 and 24 hours. The copper foil did not appreciably scavenge. Copper oxide showed some slow scavenging ability. Blends of the copper powders with 5 Å molecular sieves showed good scavenging.

The results also show that the zinc acetate and hydrated black iron oxide samples had excellent scavenging ability with all of the $H_2S$ removed in less than 15 minutes. The data in Table 2 also shows that the CuX, which has copper present in the metallic state, was a slower scavenger than seen with pure copper powder and took from 4 to 7 days to scavenge all of the $H_2S$ gas. The Cu (II)X scavenged more rapidly and took less than 24 hours to scavenge all of the $H_2S$. The copper in this sample was not in the zero valence, metallic state, but in the ionic form. The copper loaded hydrotalcites prepared from copper (II) sulfate and copper (I) chloride showed good scavenging with several of the samples scavenging all of the $H_2S$ in less than 24 hours. The copper in this sample was not in the zero valence, metallic state, but in the ionic form.

Hydrogen Sulfide Scavenging in the Presence of Moisture:

In the next series of tests several of the better scavenging materials identified above (from Table 2) were re-tested to measure the effect of added moisture on the scavenging performance of each material. Since the materials may potentially be used in a sachet in a "wet" package environment, it is beneficial that they function as well wet as they do dry. Each powder was packaged in a sampling vial and two drops of water were added. $H_2S$ was then added and testing via GC proceeded as standard. The results are given in Table 3.

The results show that the copper powders increased in their scavenging ability when wetted vs. dry (Table 2) and the CuX was substantially improved over the results seen in the dry state (Table 2), with total scavenging accomplished in less than 4 hours.

In contrast, the 5 Å and 13× molecular sieves and the ABSCENTS™ 2000 and 3000 powders were strongly negatively affected by the addition of the water with none of the samples completely scavenging the added $H_2S$ over the test time. Additionally, the zinc acetate and iron oxide scavenging were also slowed by the addition of the water, but they still scavenged all the $H_2S$ in less than 24 hours.

TABLE 3

Hydrogen Sulfide Scavenging Water Treated Samples

| | Sample | Hydrogen Sulfide µg/L | | | | | | | |
|---|---|---|---|---|---|---|---|---|---|
| Sample ID | Amt. grams | 0 | 15 min | 1 hour | 4 hours | 24 hours | 4 days | 7 days | 14 days |
| Cu powder, 3µ (35745-6) with water | 0.0106 | 10196 | 3612 | 1570 | 0 | | | | |
| Cu powder 1µ (44750-1) with water | 0.0151 | 9838 | 7475 | 2850 | 1287 | 258 | 0 | | |
| CuX with water | 0.0143 | 11276 | 7382 | 3797 | 168 | 0 | | | |
| ACTI-GEL ™ 208 with water | 0.0119 | 12222 | 12721 | 12045 | 9563 | 4297 | 375 | 0 | |
| molecular sieves, 5A with water | 0.0142 | 12663 | 12991 | 11991 | 10412 | 7426 | 3523 | 2807 | 2826 |
| molecular sieves 5A blend/Cu powder 44750-1 with water | — | 10636 | 10134 | 8955 | 4305 | 642 | 0 | | |
| iron(III) oxide with water | 0.0239 | 12357 | 10850 | 7444 | 684 | 0 | | | |
| zinc acetate with water | 0.0258 | 11555 | 11239 | 7665 | 3345 | 0 | | | |
| 13x molecular sieves wet | 0.0247 | 11956 | 10912 | 9449 | 9090 | 8020 | | | |
| Alfa Aesar Cu <0.2µ wet | 0.0223 | 2733 | 0 | | | | | | |
| Alfa Aesar Cu 3–5 µm wet | 0.0254 | 5218 | 339 | 0 | | | | | |
| ABSCENTS ™ 2000 - wet | 0.0153 | 12078 | 13447 | 12978 | 11825 | 8366 | 4991 | 4059 | |
| ABSCENTS ™ 3000 - wet | 0.0122 | 11442 | 11324 | 10849 | 10167 | 9277 | 3173 | 1435 | |

TABLE 4

Methanethiol Scavenging of Wet Samples
(Initial methanethiol concentration 20.709 µg/L)

| | Amount | Methanethiol (micrograms/liter) | | | | | |
|---|---|---|---|---|---|---|---|
| Sample ID | (g) | 30 min. | 1 hr. | 3 hr. | 24 hr. | 48 hr. | 96 hr. |
| zinc oxide (60 nm)† | 0.005 | 1579 | 756 | | 384 | 375 | 333 |
| zinc stearate | 0.005 | 21183 | 19965 | | 16233 | 14996 | 12277 |
| Cu powder (3 µm) | 0.005 | 19826 | 18818 | | 10878 | 7214 | 1143 |
| Cu powder (0.2 µm) | 0.005 | 17790 | 16125 | | 1319 | 874 | 395 |
| Cu(I) oxide | 0.005 | 19806 | 186350 | | 12083 | 7706 | 1618 |
| Cu(II) oxide | 0.005 | 18918 | 17158 | | 6906 | 474 | 402 |
| iron based oxygen scavenging sachet‡ | 0.677 | 1780 | 26 | 12 | | | |
| iron based oxygen scavenging sachet‡ | 0.005 | 2741 | 2640 | 2172 | | | |

†from Elementis Pigments
‡from Multisorb Technologies Inc.

The data in Table 4 shows that zinc oxide, zinc stearate, copper powder, copper oxide, and the contents of oxygen scavenging sachets can scavenge methanethiol. The iron (oxide) is particularly effective as is zinc oxide, fine copper powder and copper oxides. Copper (II) oxide appears to be somewhat more effective than copper (I) oxide.

TABLE 5

Hydrogen Sulfide Scavenging of Samples (Initial $H_2S$ concentration 14.671 μg/L)

| Sample ID | Amount (g) | Hydrogen Sulfide (micrograms/liter) 30 min. | 1 hr. | 3 hr. | 24 hr. | 48 hr. | 72 hr. |
|---|---|---|---|---|---|---|---|
| black† iron oxide (wet) | 0.005 | 11031 | 6804 | 200 | 0 | | |
| brown† iron oxide (wet) | 0.005 | 9461 | 2185 | 0 | | | |
| yellow† iron oxide (wet) | 0.005 | 12053 | 9471 | 3780 | 0 | | |
| red† iron oxide (wet) | 0.005 | 12916 | 10762 | 4852 | 602 | | |
| zinc oxide <1 μm (dry) | 0.010 | 0 | | | | | |
| zinc oxide <1 μm (dry) | 0.005 | 13938 | 8237 | | 7101 | | |
| zinc oxide <1 μm (wet) | 0.005 | 9935 | 8012 | | | | 0 |
| zinc stearate (dry) | 0.010 | 17318 | 10358 | 7431 | 5620 | | |
| zinc stearate (wet) | 0.005 | 348 | 126 | 0 | | | |
| zinc acetate (dihydrate - dry) | 0.010 | 0 | | | | | |
| zinc acetate (dihydrate - dry) | 0.005 | 105 | 45 | | 0 | | |
| zinc acetate (dihydrate - wet) | 0.005 | 12023 | 6738 | | | | 0 |
| Cu powder (0.2–0.3 μm - dry) | 0.010 | 0 | | | | | |
| Cu powder (0.2–0.3 μm - dry) | 0.005 | 0 | | | | | |
| Cu powder (0.2–0.3 μm - wet) | 0.005 | 11396 | 10103 | 8004 | | | 225 |
| Cu powder (3 μm - wet) | 0.005 | 2285 | 0 | | | | |
| Cu(I) oxide (wet) | 0.005 | 0 | | | | | |
| Cu(II) oxide (wet) | 0.005 | 12556 | 12196 | 9462 | 0 | | |
| iron based oxygen scavenging sachet‡ | 0.693 | 0 | | | | | |
| iron based oxygen scavenging sachet‡ | 0.005 | 4609 | 0 | | | | |
| MgO (nano - wet) | 0.005 | 371 | 332 | 173 | | | |
| CaO (nano - wet) | 0.005 | 0 | | | | | |
| $Al_2O_3$ (nano - wet) | 0.005 | 10911 | 9052 | 6325 | 358 | 0 | |
| ZnO (nano - wet) | 0.005 | 808 | 0 | | | | |
| CuO (nano - wet) | 0.005 | 647 | 0 | | | | |
| $CeO_2$ (nano - wet) | 0.005 | 9108 | 7517 | 4479 | 1082 | 337 | |

†Pigment grades from Elementis Pigments.
‡from Multisorb Technologies Inc.

The data in Table 5 shows that iron oxide, zinc oxide, zinc stearate, zinc acetate, copper powder, copper oxides, and the contents of an iron based oxygen scavenging sachet are all capable of absorbing hydrogen sulfide. Nano particle magnesium oxide, calcium oxide, copper oxide, alumina, and ceria are also effective. The data shows that the smaller particle sizes are typically faster in scavenging hydrogen sulfide. Nano particles can be dispersed in polymer substrates without substantially adversely affecting the optical properties of the relevant layer or film. When transparency is desired, nano particulate sulfur scavengers can provide benefit.

Several samples were then tested, which were PE1 films, which contained varying amounts of several of the sulfur scavengers identified above in the powder testing. Small samples of the films were cut and placed in the sample vials and tested dry and/or wetted with water following the standard GC method. The film samples showed very good scavenging, with all of the $H_2S$ scavenged in less than 4 hours for all the tested samples. The effect of added moisture was negligible in this test. The data is reported in Tables 6 and 7.

TABLE 6

Hydrogen Sulfide Scavenging Film Samples

| Sample ID | Sample Amount Film Grams | Hydrogen Sulfide ppm 0 | 15 min | 1 hour | 4 hours | 24 hours |
|---|---|---|---|---|---|---|
| 5A molecular sieves @ 10% in PE1 film | — | 15700 | 8861 | 3483 | 365 | 0 |

TABLE 6-continued

Hydrogen Sulfide Scavenging Film Samples

| Sample ID | Sample Amount Film Grams | Hydrogen Sulfide ppm 0 | 15 min | 1 hour | 4 hours | 24 hours |
|---|---|---|---|---|---|---|
| 5A molecular sieves @ 10% in PE1 film-wet | 2.76 | 14023 | 9618 | 3143 | 0 | |
| 5A molecular sieves @ 20% in PE1 film | — | 14226 | 6458 | 1235 | 0 | |
| 5A molecular sieves @ 20% in PE1 film-wet | 2.92 | 14344 | 7341 | 1938 | 0 | |
| 13 X sieves in PE1, 10% - wet | 2.99 | 12595 | 8469 | 2273 | 0 | |
| copper powder, 3μ, (35745-6) in PE1 10% | — | 14056 | 8908 | 2446 | 0 | |
| copper powder, 3μ, (35745-6) in PE1 10% - wet | 2.86 | 14672 | 6172 | 379 | 0 | |
| copper powder, 3μ, (35745-6) in PE1, 20% | — | 14988 | 7503 | 1307 | 0 | |
| copper powder, 3μ, (35745-6) in PE1, 20% - wet | 2.91 | 13951 | 4972 | 0 | | |
| zinc acetate dihydrate in PE1 10% - wet | 2.80 | 12342 | 0 | | | |
| iron oxide, black in PE1 10% - wet | 3.11 | 16975 | 9186 | 2238 | 0 | |

TABLE 7

Hydrogen Sulfide Scavenging Film Samples
Tested wet with Initial concentration 14,671 μg/L

| Sample ID | Film Amount (g) | Hydrogen Sulfide μg/L 24 hr. | 96 hr. | 7 days | 11 days |
|---|---|---|---|---|---|
| ION1 | 0.5 | 0 | | | |
| PE2 + 2% zinc oxide | 0.5 | 0 | | | |
| PE2 + 0.02% 3 μm Cu powder | 0.5 | 13249 | 10597 | 9423 | 8721 |
| PE2 + 0.2% 3 μm Cu powder | 0.5 | 10456 | 6243 | 5060 | 3010 |
| PE2 + 0.02% 0.2–0.3 μm Cu powder | 0.5 | 12242 | 9990 | 8639 | 6197 |
| PE2 + 0.2% 0.2–0.3 μm Cu powder | 0.5 | 10465 | 864 | 439 | 0 |
| PE2 + 0.02% Cu(II) oxide | 0.5 | 13450 | 11485 | 9529 | 7892 |

The data in Table 7 shows that zinc ionomer is particularly effective in scavenging hydrogen sulfide as is PE2 containing 2% zinc oxide. Copper powders in PE2 were slower scavenging, with the smaller particle size being faster.

TABLE 8

Methanethiol Scavenging Film Samples
Tested wet with Initial concentration 20,709 μg/L

| Sample ID | Film Amount (g) | Methanethiol (micrograms/liter) 1 hr. | 24 hr. | 48 hr. | 72 hr. | 96 hr. |
|---|---|---|---|---|---|---|
| PE2 (control) | 0.5 | 20954 | 20596 | | | |
| ION1 | 0.5 | 7223 | 1307 | | | |
| ION1 | 3.0 | | 402 | 257 | 0 | |
| ION1 + 0.2% Cu powder (0.2 μm) | 0.5 | | 2959 | 1752 | | 716 |
| ION1 + 0.02% Cu(II) oxide | 0.5 | | 2751 | 1224 | | 929 |

TABLE 8-continued

Methanethiol Scavenging Film Samples
Tested wet with Initial concentration 20,709 μg/L

| Sample ID | Film Amount (g) | Methanethiol (micrograms/liter) 1 hr. | 24 hr. | 48 hr. | 72 hr. | 96 hr. |
|---|---|---|---|---|---|---|
| PE2 + 2% zinc stearate | 3.0 | | 3766 | 3147 | 2525 | |
| PE2 + 2% zinc oxide | 0.5 | | 1932 | 592 | | 270 |
| PE2 + 2% zinc oxide | 3.0 | | 494 | 391 | 278 | |
| PE2 + 0.02% Cu(II) oxide | 0.5 | | 16285 | 14011 | | 10488 |
| PE2 + 0.2% Cu powder (0.2 μm) | 3.0 | | 0 | 0 | | |

The data in Table 8 shows that pure PE2 does not by itself scavenge methanethiol; however, PE2 with zinc oxide or copper powder is an effective scavenger. Zinc ionomer (ION1) is an effective scavenger of methanethiol as well. Although combinations of ION1 and copper powder or copper oxide appear to scavenge more slowly, the overall capacity to absorb sulfur compounds is expected to be greater.

Empty Package Tests

Empty packages were formed on a Multivac R230 thermoforming machine. The thermoforming web was an easy open barrier material (RDX 5085) from Cryovac and the lidding film was T0250B from Cryovac, which has a zinc ionomer sealant (Surlyn 1650) about 5 μm thick. The area of the top web was 236.5 $cm^2$ and the packages had a volume of 450 cc. Into two pouches was injected 120 μL (226 μg) of methanethiol and into two pouches was injected 160 μL (216 μg) of hydrogen sulfide. Into another two pouches was injected 120 μL methanethiol and 160 μL hydrogen sulfide. The injection points in the pouches were sealed with vinyl tape. Headspace samples from the pouches were analyzed at 24 and 48 hours and at 6 days. After 24 hours, hydrogen sulfide could not be detected in any of the pouches. The following data was obtained on methanethiol concentration.

TABLE 9

Methanethiol Concentration in Empty Packages with Zinc Ionomer Sealant

| Sample ID | Pouch Number | Methanethiol μg/L 0 hr. | 24 hr. | 48 hr. | 6 days |
|---|---|---|---|---|---|
| methanethiol only | 1 | 502 | 47 | 36 | 42 |
| methanethiol only | 2 | 502 | 52 | 33 | 38 |
| $H_2S$ and methanethiol | 1 | 480 | 42 | 34 | 27 |
| $H_2S$ and methanethiol | 2 | 480 | 42 | 35 | 30 |

The data in Table 9 shows that a package using zinc ionomer as the sealant is capable of absorbing hydrogen sulfide and methanethiol. Although not all of the methanethiol was removed from the test packages, greater than 90% was scavenged in this test.

Poultry Packaging Tests

Test Series 1-3.5 Gram Sulfur Scavenger

Seven sachet formulations were tested, (see Table 10). The sachets were 2"×2" and contained 3.5 gram of scavenger material. The chicken parts (thighs) were obtained from the local grocery and were 9 days post processing upon re-packaging in barrier bags. In this set, all samples containing the sachets and chicken parts were vacuum packaged, including a control.

After aging 7 days in the barrier bags, the samples were opened and tested in random order and ranked according to strength of odor. The results are detailed in Table 10. The data shows that most of the sachets have less odor than controls at this time.

TABLE 10

Vacuum Packaged Chicken -Organoleptic Testing
After 7 days in Barrier Bags (Total Age 16 days) 3.5 g Sachets

| Sample | Rank of $H_2S$ Odor none | Weak | strong | Comments |
|---|---|---|---|---|
| CuX | w | | | no odor, better than control |
| Cu powder, 1μ, Alfa Aesar | | w | | very slight, better than control |
| 5A molecular sieves | w | | | no odor, better than control |
| 13X molecular sieves | w | | | no odor, better than control |
| zinc oxide | | w | | odor, worse than control |
| iron oxide, hydrated | | w | | slight odor, same as control |
| zinc acetate | | w | | very slight, better than control |
| Control A | | w | | slight odor |
| Control B | | w | | slight odor |
| Control C | | w | | slight odor |

After aging 14 days in the barrier bags (total age post processing is 23 days), the samples were opened and tested in random order and ranked according to strength of odor. The results are detailed in Table 11. The data shows that several of the sachets are continuing to show less odor than the controls after this length of time, particularly the copper powder, 5 A and 13× molecular sieves, and the zinc oxide.

TABLE 11

Vacuum Packaged Chicken -Organoleptic Testing
After 14 days in Barrier Bags (Total Age 23 days)
3.5 g Sachets

| Sample | Rank of $H_2S$ Odor none | weak | strong | Comments |
|---|---|---|---|---|
| CuX | | | x | as bad as control |
| Cu powder, 1μ, Alfa Aesar | | x | | better than control |
| 5A molecular sieves | | x | | very little odor, much better than control |
| 13X molecular sieves | | x | | very little odor, much better than control |

TABLE 11-continued

Vacuum Packaged Chicken -Organoleptic Testing
After 14 days in Barrier Bags (Total Age 23 days)
3.5 g Sachets

| Sample | Rank of $H_2S$ Odor: none | weak | strong | Comments |
|---|---|---|---|---|
| zinc oxide | | x | | little odor, better than control |
| iron oxide, hydrated | | | x | strong odor, slightly worse than control |
| zinc acetate | | | x | strong odor, slightly worse than control |
| Control A | | | x | strong odor |
| Control B | | | x | strong odor |
| Control C | | | x | strong odor |

The above data of Tables 10 and 11 demonstrates that several sachet formulations were tested and found to offer a significant improvement in reduction of sulfurous odor formation in poultry vacuum packaged in barrier film.

Scavenging Blend Formulations for Sachets/PE1 Films

Additional compositions were evaluated for use in poultry packaging. This included sulfur scavenging materials tested as incorporated into film, additional sachet formulations and sulfur scavenging/carbon dioxide generating/oxygen scavenging multi action film/sachet blends. Samples were prepared in the weight ratios as follows:

Trial 6 - $CO_2$ Generator with Sulfur Scavenger and $O_2$ Scavenger in Film

| | |
|---|---|
| sodium bicarbonate | 5.00 g |
| fumaric acid | 4.00 g |
| Cu powder, <0.2μ | 1.00 g |
| 13X molecular sieves | 1.00 g |
| HTC-BS (NtBk.#33619-4) | 2.00 g |

Trial 15 - Sulfur Scavenger in 3.5 g sachets

| | |
|---|---|
| CuX | 7.5 g |
| $CaCl_2$ | 2.5 g |

Trial 16 - $CO_2$ Generator with Sulfur Scavenger in 3.5 g sachets

| | |
|---|---|
| sodium bicarbonate | 7.08 g |
| fumaric acid | 4.20 g |
| $CaCl_2$ | 1.95 g |
| copper powder, <0.2μ | 2.00 g |

Trial 17 - $CO_2$ Generator with Sulfur Scavenger in 3.5 g sachets

| | |
|---|---|
| sodium bicarbonate | 7.08 g |
| citric acid | 4.20 g |
| $CaCl_2$ | 1.95 g |
| copper powder, <0.2μ | 2.00 g |

Trial 18 - Sulfur Scavenger with $O_2$ Scavenger in 3.5 g Sachet

| | |
|---|---|
| Cu powder, 1μ | 5.4 g |
| 5 Å molecular sieves | 5.4 g |
| LaRoche HTC-BS | 7.2 g |

Trial 19 - $CO_2$ Generator with Sulfur Scavenger in 3.5 g sachets

| | |
|---|---|
| sodium bicarbonate | 7.08 g |
| fumaric acid | 4.20 g |
| $CaCl_2$ | 1.95 g |
| Cu powder, <0.2μ | 1.00 g |
| 13X molecular sieves | 1.00 g |

Trial 20 - $CO_2$ Generator with Sulfur Scavenger and $O_2$ Scavenger in 3.5 g Sachets

| | |
|---|---|
| sodium bicarbonate | 5.00 g |
| fumaric acid | 4.00 g |
| $CaCl_2$ | 2.00 g |

-continued

| | |
|---|---|
| Cu powder, <0.2μ | 1.00 g |
| 13X molecular sieves | 1.00 g |
| HTC-BS | 2.00 g |

Trial 21 - $CO_2$ Generator with Sulfur Scavenger and $O_2$ Scavenger in 3.5 g Sachets

| | |
|---|---|
| sodium bicarbonate | 5.00 g |
| fumaric acid | 4.00 g |
| $CaCl_2$ | 2.00 g |
| Cu powder, <0.2μ | 1.00 g |
| 13X molecular sieves | 1.00 g |
| sodium ascorbate | 2.00 g |
| ferrous sulfate | 0.50 g |

Trial 22 - Sulfur Scavenger in 3.5 g Sachets

| | |
|---|---|
| 13X molecular sieves | 7.5 g |
| Cu powder | 7.5 g |

Trial 23 - Sulfur Scavenger and $O_2$ Scavenger in 3.5 g Sachets

| | |
|---|---|
| Cu powder | 7.5 g |
| HTC-BS | 7.5 g |

Trial 24 - $CO_2$ Generator with Sulfur Scavenger and $O_2$ Scavenger - multi system approach:
1 - film containing 20% Cu powder in PE1
2 - 3.5 g sachet containing the following:

| | |
|---|---|
| sodium bicarbonate | 4.7 g |
| fumaric acid | 2.8 g |
| HTC-BS | 1.1 g |
| $CaCl_2$ | 1.3 g |
| copper powder (1 micron) | 1.0 g |

Trial 25 - another multi system approach:
1 - film containing 20% 5A (5 Angstrom) sieves in PE1
2 - 3.5 g sachet containing the following: (same as above Trial # 24)

| | |
|---|---|
| sodium bicarbonate - | 4.7 g |
| fumaric acid - | 2.8 g |
| HTC-BS (Huber) - | 1.1 g (ref # 33619-4) |
| $CaCl_2$ - | 1.3 g |
| copper powder (1 micron) - | 1.0 g |

The chicken used in this trial was purchased at a local supermarket. It was 9 days post kill upon packaging in this test. After packaging in barrier bags, organoleptic "sniff" tests were conducted on days 7, 14, 21 and some samples were tested at 28/30 days. That is, the samples were tested 16, 23, 30 and 37/39 days post kill respectively. Controls were run with the chicken vacuum packaged in the P640B bags, without any control film or sachets. Samples were started on three different days. Samples 1 through 8 were tested first, Samples 9 through 16 were set up second, and Samples 17 through 25 were tested last. Control samples were prepared for each set of tests. The test results are given in Table 12. The test lasted 30 days for Trials 17 and Control 9.

TABLE 12

Results of Odor Evaluation

| Trial # | Sample Description | Rank of $H_2S$ odor: none | weak | strong |
|---|---|---|---|---|
| Control 1 | | | w | x y |
| Control 2 | | | w | x y |
| Control 3 | | | w | x y |
| 1 | 10% 5A molecular sieves/film | | w | x y |
| 2 | 10% 13x molecular sieves/film | | w | x y |
| 3 | 10% copper powder/film | | w | x y z |
| 4 | 10% Zn acetate/film | | w x | y |
| 5 | 10% iron (III) oxide/film | | w | xy |

TABLE 12-continued

Results of Odor Evaluation

| Trial # | Sample Description | Rank of $H_2S$ odor none | weak | strong |
|---|---|---|---|---|
| 6 | 10% $CO_2$ generator & $O_2$ scavenger/film | | w x | y |
| 7 | 20% CuX/film | w | | x y |
| 8 | 5% Cu powder, <0.2 micron/film | | w | x y z |
| Control 4 | | | w x | y |
| Control 5 | | | w x | y |
| Control 6 | | | w | x y |
| 9 | 10% Cu powder, <0.2 micron/film | | w x | y |
| 10 | 20% Cu-HTC film (Cu(II) sulfate) | w | x | y |
| 11 | 20% Cu-HTC film (Cu(I) chloride) | w | x | y |
| 12 | 20% 13x molecular sieves/film | | w | x y |
| 13 | 10% fresh ABSCENTS ™ 2000/film | | w x | y |
| 14 | 10% fresh ABSCENTS ™ 3000/film | w | x | y |
| 15 | sachet of $Cu^0X$ & $CaCl_2$ | | w x | y |
| 16 | sachet: $CO_2$ generator, $H_2S$ scavenger | w | x | y |
| Control 7 | | | w x | y z |
| Control 8 | | | w x | y z |
| Control 9 | | | w x | y z |
| 17 | sachet: $CO_2$ generator, $H_2S$ scavenger | w x | y z | |
| 18 | sachet: $CO_2$ generator, $H_2S$ and $O_2$ scavenger | | w x | y z |
| 19 | sachet: $CO_2$ generator, $H_2S$ scavenger | w x | y | z |
| 20 | sachet: $CO_2$ generator, $O_2$ & $H_2S$ scavenger | w x y | z | |
| 21 | sachet: $CO_2$ generator, $O_2$ & $H_2S$ scavenger | w x | y | z |
| 22 | sachet: $O_2$ & $H_2S$ scavenger 13x molecular sieves & Cu powder (0.2–0.3 micron) | w | x | y z |
| 23 | sachet: $O_2$ & $H_2S$ scavenger Cu powder (1 micron) & HTC-BS | w | x | y z |
| 24 | 20% Cu film & sachet $CO_2$ generator, $O_2$ & $H_2S$ scavenger | w x y z | | |
| 25 | 20% 5A film & sachet $CO_2$ generator, $O_2$ & $H_2S$ scavenger | w x | y z | |

Analysis of the data shows that at 7 days the majority of the 25 test packages showed better organoleptics than the controls, (only trials 2, 5, 12, 15 and 18 were the same or worse). At 14 days 15 of the samples continued to show better performance than the controls (Trials 1, 3, 4, 6, 8, 11, 13, 16, 17, 19, 20, 21, 23, 24, and 25). At 21 days 11 samples continued to show improved performance over the controls, (1, 3, 6, 8, 16, 17, 19, 20, 21, 24, and 25).

The oxygen scavenger and sulfur scavenger of the invention can in some embodiments comprises the same material. Thus, a single composition, material, etc. can function both as the oxygen scavenger and the sulfur scavenger.

Alternatively, and typically, the oxygen scavenger and the sulfur scavenger will comprise discrete and separately identifiable compositions, layers, etc.

The invention is not limited to the illustrations described herein, which are deemed to be merely illustrative, and susceptible of modification of form, size, arrangement of parts and details of operation.

What is claimed is:

1. A coextruded, heat shrinkable oxygen scavenger film comprising:

a) a layer comprising a blend of:

i) a sulfur scavenger comprising one or more materials selected from the group consisting of (a) copper metal, copper foil, or copper powder, where the copper is in the zero valence state;

(b) silica, hydrotalcite, or alumina treated with copper in the ionic or zero valence state;

(c) zinc acetate, zinc oxide, zinc stearate, or zinc ionomer;

(d) iron oxide;

(e) copper (II) oxide;

(f) magnesium oxide;

(g) calcium oxide;

(h) alumina; and (i) ceria; and (ii) a polymer comprising one or more materials selected from the group consisting of:

(a) ethylene/alpha olefin copolymer;

(b) polypropylene;

(c) low density polyethylene;

(d) ethylene/vinyl acetate copolymer;

(e) ethylene/acrylic acid copolymer;

(f) ethylene/methacrylic acid copolymer; and (g) ionomer;

b) a layer comprising an oxygen scavenger comprising one or more materials selected from the group consisting of i) ethylenically unsaturated hydrocarbon, ii) a polymer having a polymeric backbone, cyclic olefinic pendent group, and linking group linking the olefinic pendent group to the polymeric backbone, iii) a copolymer of ethylene and a strained, cyclic alkylene, and iv) ethylene/vinyl aralkyl copolymer; and c) a layer comprising an ethylene polymer or copolymer; wherein the film has a free shrink of at least 8% in either or both of the longitudinal and transverse directions.

2. The oxygen scavenger film of claim 1 wherein the oxygen scavenger further comprises a transition metal catalyst wherein the transition metal is cobalt.

3. The oxygen scavenger film of claim 2 wherein the oxygen scavenger further comprises a photoinitiator.

4. The film of claim 1 wherein the film comprises a layer comprising an oxygen barrier having an oxygen permeability less than 100 $cm^3O_2/m^2$·day·atmosphere (tested at 1 mil thick and at 25° C. according to ASTM D3985).

* * * * *